US010627113B2

(12) United States Patent
Aguilar et al.

(10) Patent No.: US 10,627,113 B2
(45) Date of Patent: Apr. 21, 2020

(54) DISTRIBUTED VERTICAL FLAME BURNER

(71) Applicant: WHIRLPOOL CORPORATION, Benton Harbor, MI (US)

(72) Inventors: Luis Javier Aguilar, Celaya (MX); Jonathan Tovar Balderas, Celaya (MX); Francisco Javier Soria Contreras, Celaya (MX); Victor Ruelas Fajardo, Celaya (MX); Victor Gerardo Caloca Galindo, Celaya (MX); Ana Katia Silva Jiménez, Celaya (MX)

(73) Assignee: Whirlpool Corporation, Benton Harbor, MI (US)

( * ) Notice: Subject to any disclaimer, the term of this patent is extended or adjusted under 35 U.S.C. 154(b) by 633 days.

(21) Appl. No.: 15/393,478

(22) Filed: Dec. 29, 2016

(65) Prior Publication Data

US 2018/0187896 A1 Jul. 5, 2018

(51) Int. Cl.

| | |
|---|---|
| ***F24C 3/04*** | (2006.01) |
| ***F24C 3/08*** | (2006.01) |
| ***F23D 14/08*** | (2006.01) |
| ***F23D 14/04*** | (2006.01) |
| ***F24C 3/02*** | (2006.01) |

(52) U.S. Cl.

CPC ..... *F24C 3/08* (2013.01); *F23D 14/04* (2013.01); *F23D 14/08* (2013.01); *F24C 3/022* (2013.01); *F23D 2203/102* (2013.01); *F23D 2203/1015* (2013.01); *F23D 2203/1017* (2013.01); *F23D 2900/14062* (2013.01)

(58) Field of Classification Search

CPC .... F23D 2203/102; F23D 14/14; F23D 14/16; F23D 14/145; F23D 2203/105; F23D 2203/103

USPC ..... 126/211–221

See application file for complete search history.

(56) References Cited

U.S. PATENT DOCUMENTS

| | | | | |
|---|---|---|---|---|
| 564,681 A | | 7/1896 | Bryan | |
| 1,129,546 A | * | 2/1915 | Brettelle | F23D 14/04 431/356 |
| 1,238,632 A | * | 8/1917 | Caister | F23D 11/44 431/210 |
| 1,364,813 A | * | 1/1921 | Ryan | F23D 14/04 431/356 |
| 1,508,873 A | * | 9/1924 | Caldwell | F23D 14/04 239/558 |
| 1,598,996 A | | 9/1926 | Wheelock | |
| 1,730,796 A | * | 10/1929 | Walbridge | F23D 14/04 431/247 |

(Continued)

FOREIGN PATENT DOCUMENTS

JP 2011144982 A 7/2011

*Primary Examiner* — Jorge A Pereiro

(74) *Attorney, Agent, or Firm* — Price Heneveld LLP

(57) ABSTRACT

A fuel-burning cooking burner includes a base defining an outer periphery and an inner open area. The burner further includes a cap coupled with the base around the outer periphery thereof and extending over the open area to define a distribution cavity on an interior side of the cap. The cap further defines a convex outer surface extending opposite the distribution cavity and a plurality of outlets extending through the cap from the distribution cavity to the exterior surface. The outlets are distributed over the entire exterior surface.

20 Claims, 5 Drawing Sheets

(56) References Cited

U.S. PATENT DOCUMENTS 1,869,942 A * 8/1932 O'Dowd ..... F24C 3/085 126/39 K
1,981,976 A * 11/1934 Wem ..... F23D 14/04 239/553.5
2,001,972 A * 5/1935 McFall ..... F23D 14/04 431/356
2,024,510 A * 12/1935 Crisenberry ..... F23D 14/04 239/402.5
2,037,400 A * 4/1936 Tschierschwitz ..... F23D 14/64 431/191
2,556,804 A * 6/1951 Fagan ..... F24C 1/14 126/93
2,560,862 A * 7/1951 Harrison ..... F23D 14/00 239/553.5
2,777,407 A 1/1957 Schindler
2,781,038 A 2/1957 Sherman
3,017,924 A 1/1962 Jenson
3,169,871 A * 2/1965 Macchi ..... A21B 1/245 426/523
3,877,865 A 4/1975 Duperow
D245,663 S 9/1977 Gordon
4,083,355 A * 4/1978 Schwank ..... F23D 14/14 126/39 J
4,518,346 A 5/1985 Pistien
4,622,946 A * 11/1986 Hurley ..... F24C 3/085 126/214 D
4,846,671 A 7/1989 Kwiatek
4,886,043 A 12/1989 Homer
D309,398 S 7/1990 Lund
5,397,234 A 3/1995 Kwiatek
D369,517 S 5/1996 Ferlin
5,649,822 A 7/1997 Gertler et al.
5,842,849 A 12/1998 Huang
6,030,207 A 2/2000 Saleri
6,092,518 A 7/2000 Dane
6,093,018 A * 7/2000 Avshalumov ..... F23C 7/00 126/39 E
6,322,354 B1 11/2001 Carbone et al.
6,619,280 B1 9/2003 Zhou et al.
6,655,954 B2 12/2003 Dane
6,663,009 B1 12/2003 Bedetti et al.
7,017,572 B2 3/2006 Cadima
D524,105 S 7/2006 Poltronieri
7,083,123 B2 8/2006 Molla
D544,753 S 6/2007 Tseng
7,291,009 B2 11/2007 Kamal et al.
D564,296 S 3/2008 Koch et al.
7,614,877 B2 11/2009 McCrorey et al.
7,628,609 B2 12/2009 Pryor et al.
7,731,493 B2 6/2010 Starnini et al.
8,057,223 B2 11/2011 Pryor et al.
8,220,450 B2 7/2012 Luo et al.
8,302,593 B2 11/2012 Cadima
8,464,703 B2 6/2013 Ryu et al.
8,535,052 B2 9/2013 Cadima
8,596,259 B2 12/2013 Padgett et al.
8,616,193 B2 12/2013 Padgett
8,689,782 B2 4/2014 Padgett
8,747,108 B2 6/2014 Lona Santoyo et al.
8,887,710 B2 11/2014 Rossi et al.
8,932,049 B2 1/2015 Ryu et al.
8,951,040 B2 2/2015 Rasi
8,978,638 B2 * 3/2015 Le Mer ..... F23D 14/62 126/193
9,074,765 B2 7/2015 Armanni
9,151,494 B2 10/2015 Quintaba' et al.
9,285,115 B2 3/2016 Gasparini
D766,036 S 9/2016 Koch
9,625,159 B2 * 4/2017 Quintaba' ..... F23D 14/085
9,816,726 B2 * 11/2017 Le Mer ..... F23D 14/62
2004/0195399 A1 10/2004 Molla
2004/0224273 A1 11/2004 Inomata
2004/0224274 A1 11/2004 Tomiura et al.
2005/0112520 A1 5/2005 Todoli et al.
2006/0147865 A1 7/2006 Czajka et al.
2007/0124972 A1 6/2007 Ratcliffe
2007/0281267 A1 12/2007 Li
2008/0050687 A1 2/2008 Wu
2009/0320823 A1 12/2009 Padgett
2010/0035197 A1 2/2010 Cadima
2010/0126496 A1 5/2010 Luo et al.
2010/0154776 A1 6/2010 Czajka et al.
2010/0192939 A1 8/2010 Parks
2010/0316967 A1 * 12/2010 Scribano ..... F23D 14/14 431/329
2011/0027733 A1 2/2011 Yamamoto et al.
2012/0017595 A1 1/2012 Liu
2012/0070792 A1 * 3/2012 Rasi ..... F23D 14/08 431/355
2013/0252188 A1 9/2013 Chen
2013/0255663 A1 10/2013 Cadima et al.
2014/0090636 A1 4/2014 Bettinzoli
2014/0116416 A1 5/2014 Saubert
2014/0318527 A1 10/2014 Silva et al.
2014/0318528 A1 * 10/2014 Quintaba' ..... F23D 14/085 126/39 E
2014/0338651 A1 11/2014 Hagström
2015/0153041 A1 6/2015 Neumeier
2015/0253012 A1 9/2015 Fáveri et al.
2015/0308677 A1 10/2015 Brouard et al.
2015/0345800 A1 12/2015 Cabrera Botello
2016/0091210 A1 3/2016 Ceccoli
2016/0178209 A1 6/2016 Park et al.
2016/0178212 A1 6/2016 Park et al.
2016/0187002 A1 6/2016 Ryu et al.
2016/0201902 A1 7/2016 Cadima
2016/0209044 A1 7/2016 Cadima
2017/0003033 A1 1/2017 Lona Santoyo et al.
2017/0122555 A1 * 5/2017 Owens ..... F23D 14/14
2018/0274781 A1 * 9/2018 Usci ..... F23N 1/022

* cited by examiner

DISTRIBUTED VERTICAL FLAME BURNER

BACKGROUND

The present device generally relates to a burner for a gas-powered cooking appliance. In one aspect, the disclosure relates to a burner having vertically-oriented flame outlets distributed across a surface thereof.

Various solutions have been developed to provide improved heat distribution in gas burner arrangements. In one example, burners have been developed with two or three concentric burner rings to distribute heat outwardly in various levels. However, such burners typically require an increased height, due to each inward level being positioned vertically above the outer levels. Further, such burners may be complex and visually unappealing. Even further, many burners that direct flames outwardly are limited in the area over which the flames are provided, requiring a large flame size, which may present efficiency issues, including the presence of a "dirty flame."

SUMMARY

According to an aspect of the present disclosure, a fuel-burning cooking burner includes a base defining an outer periphery and an inner open area. The burner further includes a cap coupled with the base around the outer periphery thereof and extending over the open area to define a distribution cavity on an interior side of the cap. The cap further defines a convex outer surface extending opposite the distribution cavity and a plurality of outlets extending through the cap from the distribution cavity to the exterior surface. The outlets are distributed over the entire exterior surface.

In at least another aspect, a fuel-burning cooking burner includes a base defining an outer periphery, an inner open area, and a mixing chamber separated from a portion of the inner open area and in communication therewith adjacent the outer periphery. The burner further includes a cap coupled with the base around the outer periphery thereof and extending over the open area to define a distribution cavity on an interior side of the cap. The cap further defines an exterior surface extending opposite the distribution cavity and a plurality of outlets extending through the cap from the distribution cavity to the exterior surface.

In at least another aspect, a cooking appliance includes an upper surface and a burner disposed along the upper surface. The burner includes a base defining an outer periphery and an inner open area. The burner further includes a cap coupled with the base around the outer periphery thereof and extending over the open area to define a distribution cavity on an interior side of the cap. The cap further defines a convex outer surface extending opposite the distribution cavity and a plurality of outlets extending generally perpendicular to the upper surface and through the cap from the distribution cavity to the exterior surface. The outlets are distributed over the entire exterior surface. A grate is disposed above the burner and supported along a portion of the upper surface.

These and other features, advantages, and objects of the present device will be further understood and appreciated by those skilled in the art upon studying the following specification, claims, and appended drawings.

DETAILED DESCRIPTION OF EMBODIMENTS

Figure 1:
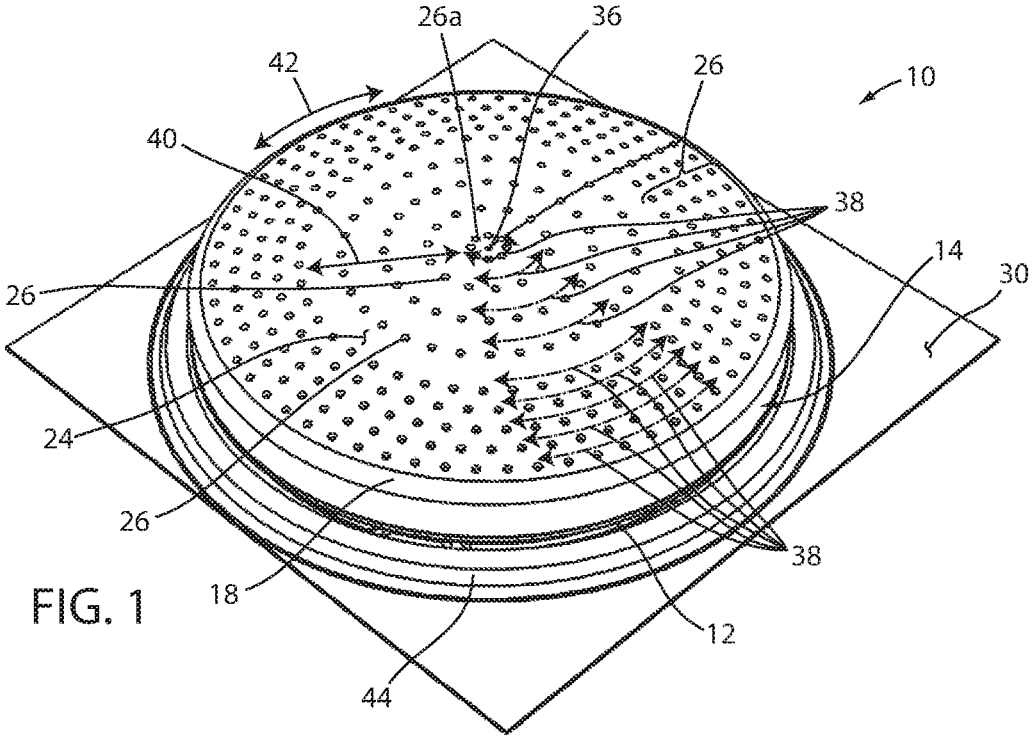
FIG. 1 is a perspective view of a burner assembly including a portion of a cooktop.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 5:
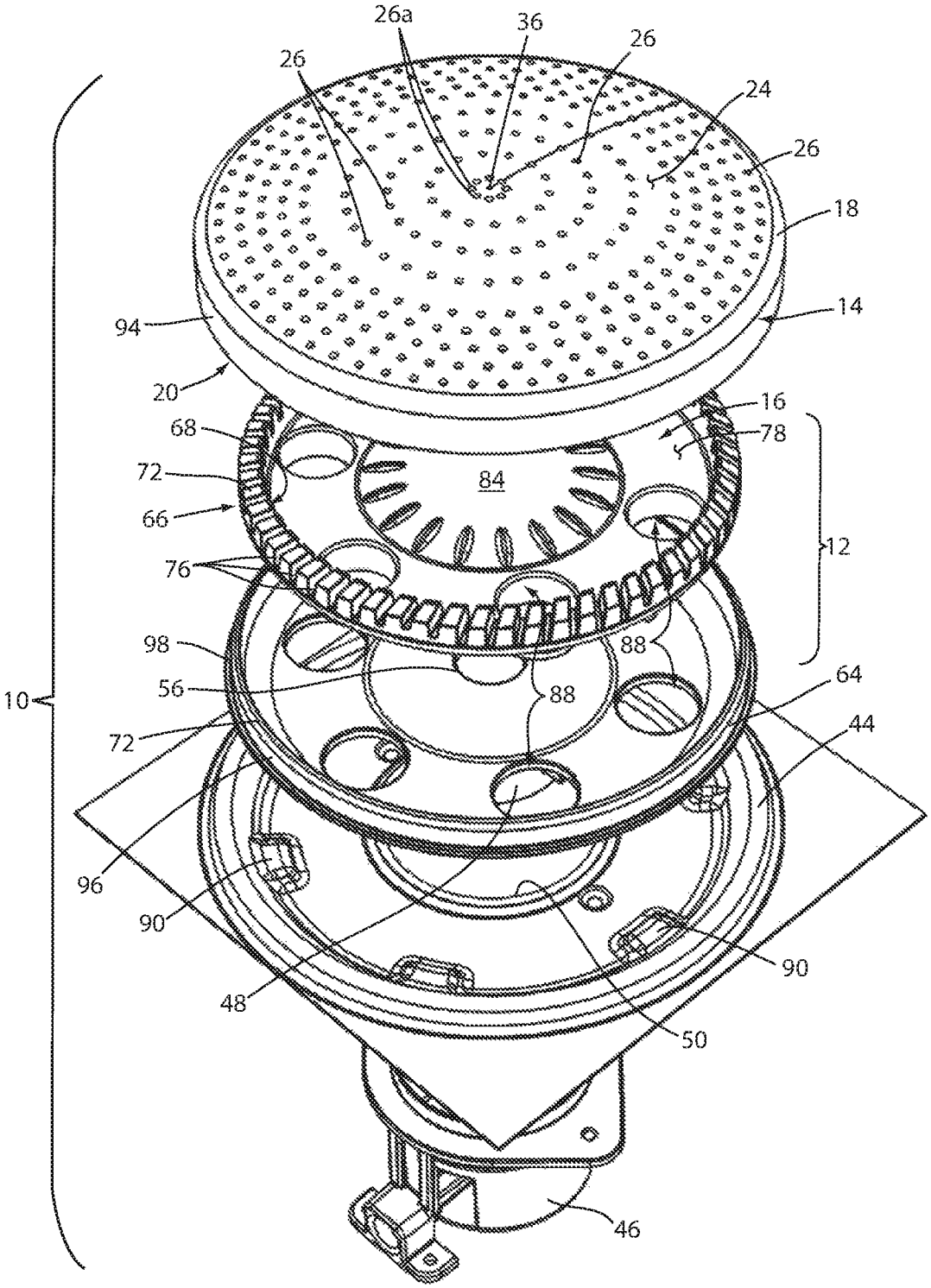
FIG. 5 is a perspective exploded view of the burner of FIG. 1, illustrating various internal components thereof.
Figure 6:
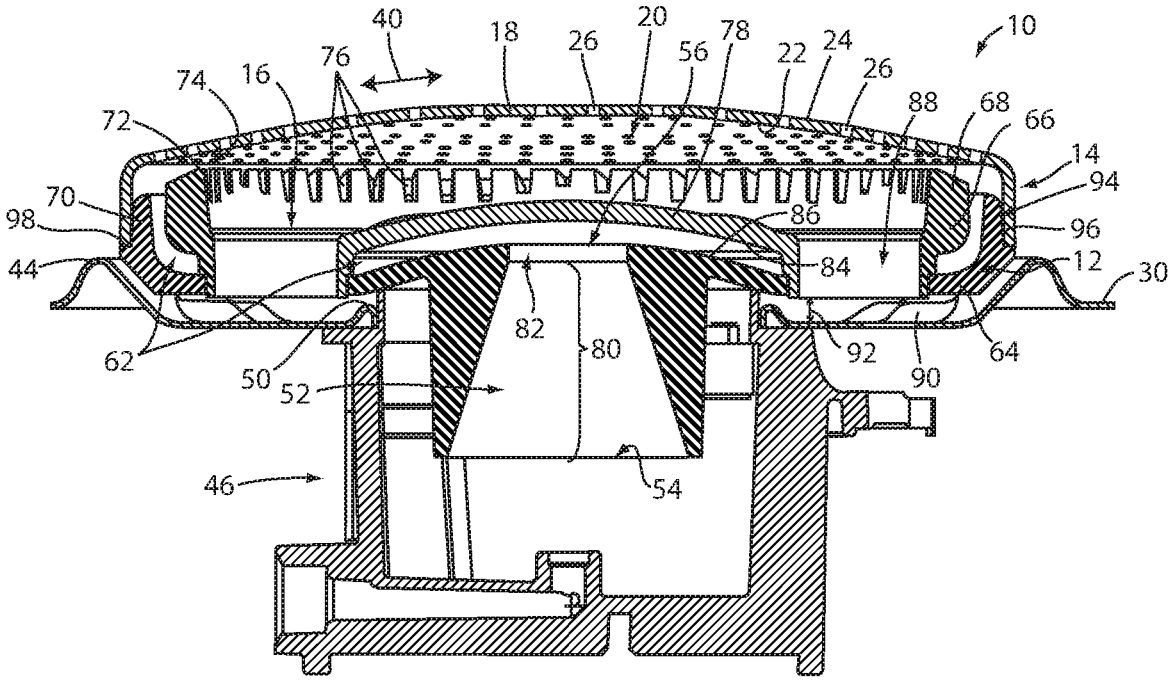
FIG. 6 is a side, cross-section view of the burner of FIG. 1.

Referring to the embodiment illustrated in FIGS. 1-6, reference numeral 10 generally designates a fuel-burning cooking burner. The burner 10 includes a base 12 defining an outer periphery 14 and an inner open area 16 (FIGS. 5 and 6). The burner 10 further includes a cap 18 coupled with the base 12 around the outer periphery 14 thereof and extending over the open area 16 to define a distribution cavity 20 on an interior side 22 of the cap 18. The cap 18 further defines an exterior surface 24 extending opposite the distribution cavity 20 and a plurality of outlets 26 extending through the cap 18 from the distribution cavity 20 to the exterior surface 24.

Figure 2:
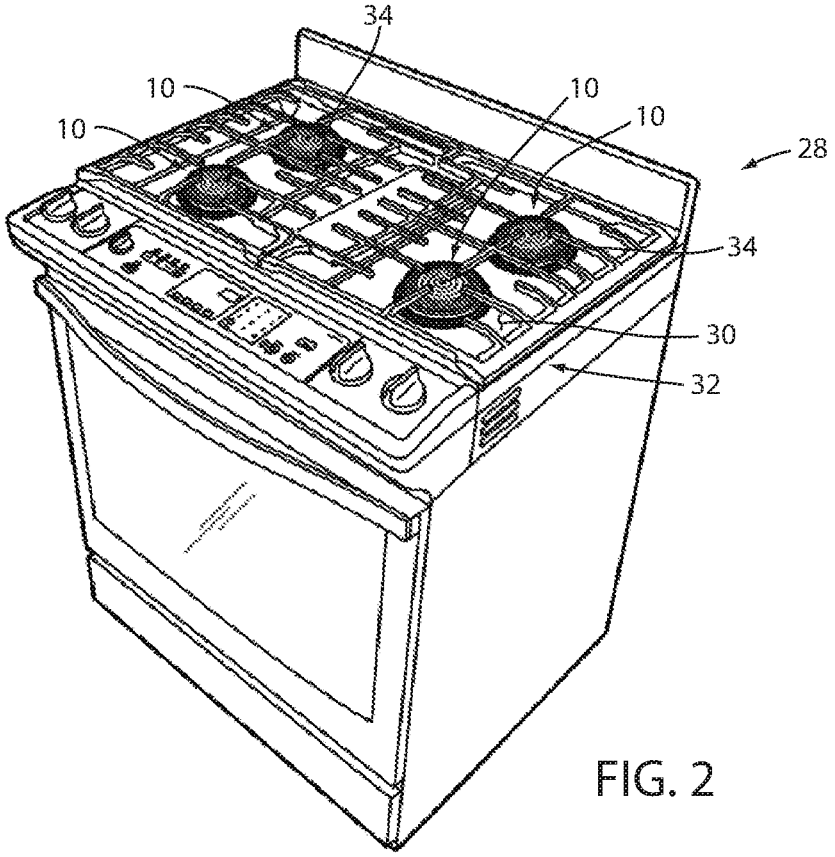
FIG. 2 is a perspective view of a cooking appliance, in the form of a range, having multiple instances of the burner of FIG. 1.
Figure 3:
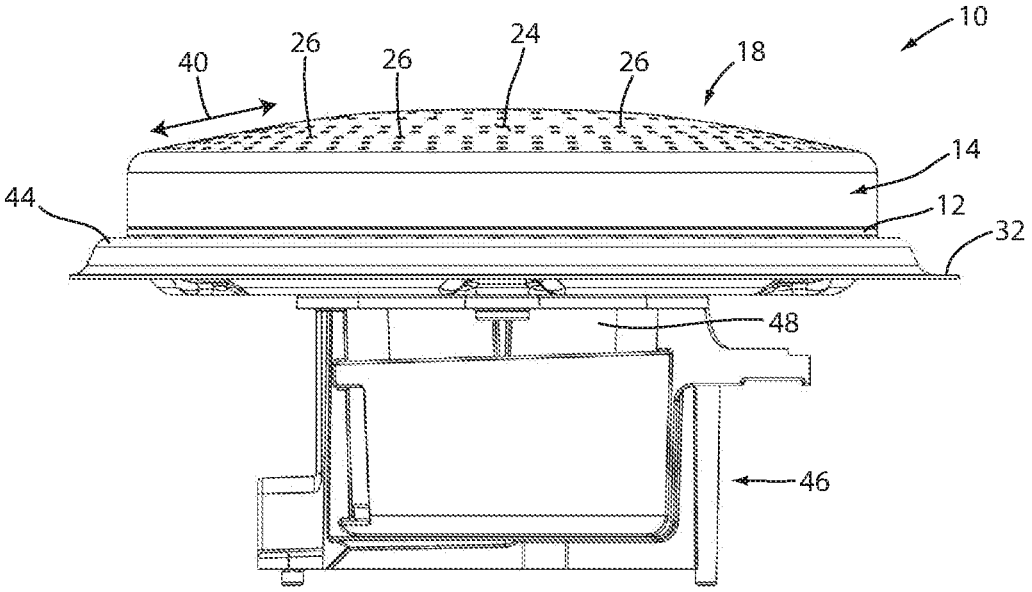
FIG. 3 is a side view of the burner assembly of FIG. 1.
Figure 4:
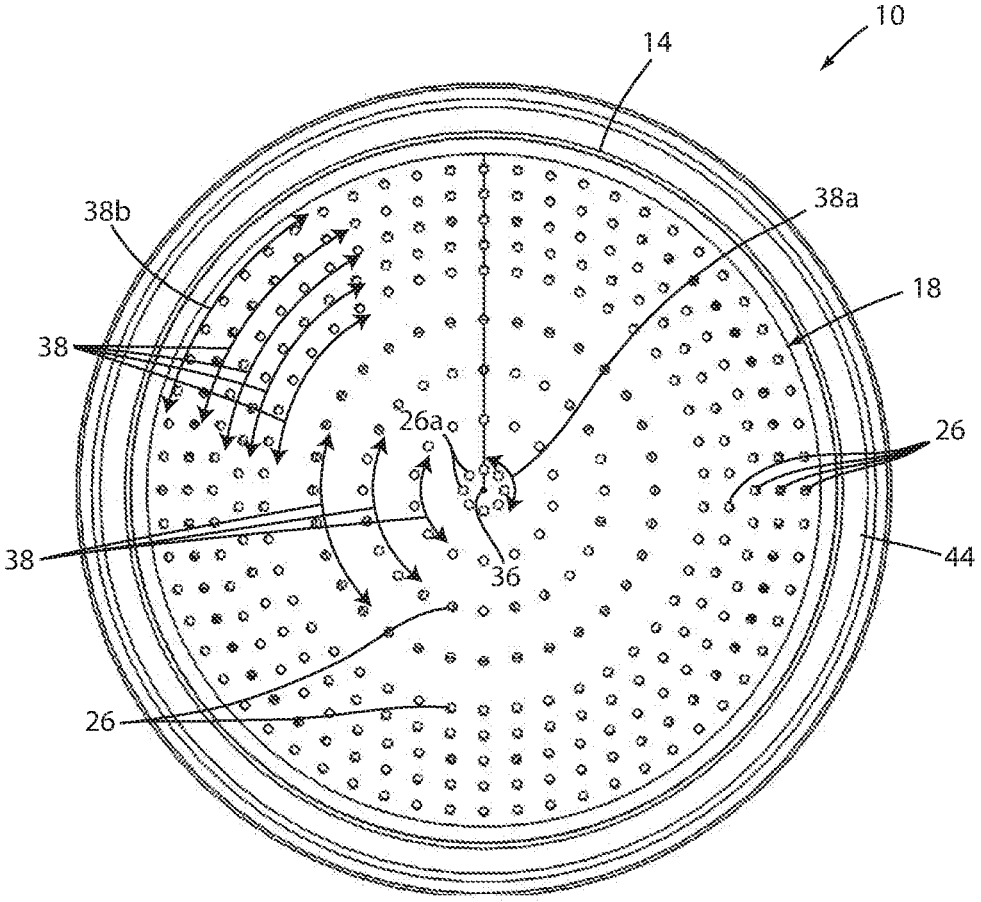
FIG. 4 is a top view of the burner assembly of FIG. 1.

As shown in FIG. 2 the burner 10 can be incorporated into a cooking appliance 28 that, as shown, may be in the form of a range fueled, at least in part, by a gaseous fuel (such as natural gas, propane, or the like). In particular, the appliance 28 includes an upper surface 30 on which burner 10 is positioned. The upper surface 30 can be defined along an upper portion of the appliance 28 that can be a part of a cooking hob 32 having a plurality of burners 10 positioned therealong and configured to provide the cooking fuel thereto, in varying desired quantities. In a further variation, the appliance 28 itself can be a stand-alone cooking hob 32 or the like. The cooking hob 32 portion of appliance 28 further includes a grate 34 or a plurality of grates 34 respectively corresponding with each burner 10 included in hob 32. The grates 34 can take any of a number of particular configurations, but are generally configured and positioned to support a variety of cooking implements above one of burners 10 for heating thereby. In this manner, the above-described burner 10 with outlets 26 being generally vertically-directed and extending over the entire exterior surface 24 or cap 18 can provide a source of heat by distribution of flames under an entire portion of the associated grate 34. In this manner, burner 10 can provide an even source of heat for at least a portion of a cooking implement positioned on grate 34. In an embodiment, each of the plurality of burners 10 included along hob 32 can be of varying sizes to correspond to various cooking implement configurations and sizes.

As mentioned above, outlets 26 can be distributed over the entire exterior surface 24 of cap 18. Generally speaking, to be distributed over the entire exterior surface 24, at least some of the outlets 26 are positioned adjacent the portion of cap 18 corresponding with the outer periphery 14 of burner 10 and at least some of the remaining outlets 26 are positioned adjacent the center 36 (e.g., the geometric center) of cap 18. In one embodiment, additional outlets 26 can be positioned tangentially between those located adjacent outer periphery 14 and center 36. In one aspect, the outlets 26 can extend in a generally consistent manner along a tangential direction 42 and a radial direction 40 of the round variation of cap 18 shown in the Figures. In the example shown in FIGS. 1-6, such distribution can be achieved by arranging outlets 26 in concentric rings 38 that emanate from adjacent center 36 of cap 18 to adjacent periphery 14, as described further below. In an alternative arrangement shown in FIGS. 7 and 8 (and discussed further below), the above-described distribution can be achieved by a variation of burner 110 including a variation of cap 118 with outlets 126 arranged in a spiral extending outwardly from adjacent center 136 in radial direction 140 with repeated traversals of cap 118 in the tangential direction 142.

Returning to FIGS. 1-4, in the ring-based arrangement of outlets 26, the outlets 26 in a center-most one of rings 38*a* can be positioned somewhat away from the actual center 36 of exterior surface 24. Nevertheless, outlets 26 in ring 38*a* can be considered adjacent center 36 by being sufficiently spaced with respect thereto to provide heat by flames emanating from outlets 26*a* at a level comparable to the outlets 26 in other areas of cap 18. In another example, outlets 26 in ring 38*a* can be positioned with respect to center 36 at a distance equal to or less than the distance to the next radially-outward ring 38*b*. Still further, the outlets 26 in ring 38*a* can be positioned relative to center 36 at a distance that maintains the spacing between outlets 26 in tangential direction 42 in a manner consistent with such spacing in other rings 38 given, for example, a number of outlets 26 in ring 38 of less than 12 but more than 3. In one example, the outlets 26 in the centermost ring 38*a* may be between about 8 mm and 2 mm from center 36 (measured in the horizontal direction from the centers of outlets 26) and, in one embodiment, may be about 4 mm from center 36.

In a similar manner, the outlets 26 in the outermost ring 38*b* can be positioned somewhat away from the outer periphery 14 of exterior surface 24 while still being considered adjacent outer periphery 14. For example, the structure of burner 10, shown in the cross-section view of FIG. 6 and described further below, may be such that the combustible fuel and air mixture is not provided to an area corresponding with outer periphery 14 such that the presence of outlets 26 over such an area would not produce flames and could disrupt the flow of the fuel-air mix to other outlets 26 or could allow for the addition of excess air to the fuel-air mix, which could interfere with the quality of flames produced by burner 10. In an example, the outlets 26 in ring 38*b* can be considered adjacent outer periphery 14 when within an area disposed toward outer periphery 14 in an area when the inner geometry of burner 10 provides adequate flow of the fuel and air mixture for outlets 26 to adequately produce a flame. In one example, the outlets 26 in the outermost ring 38*b* may be between about 5 mm and 10 mm from outer periphery 14 (measured in the horizontal direction from the centers of outlets 26) and, in one embodiment, may be about 7 mm from outer periphery 14.

As further shown in FIGS. 1-4, the size of outlets 26 overall and the spacing thereof in the individual rings 38 in tangential direction 42 can be generally consistent. The outlets 26 can be circular having a diameter of between 1 mm and 2.5 mm and, in one embodiment about 2 mm. In particular, the area of the outlets 26 can vary with the size of burner 10, the total number of outlets 26, the desired heat output therefrom, as well as the desired internal pressure of the fuel and air mixture within burner 10 prior to exiting outlets 26. In an embodiment, all outlets 26 in burner 10 can be approximately the same size and shape; however, in other embodiments, the sizes and shapes of outlets 26 can vary according to desired output levels within the area of hob 32 occupied by a particular burner 10 or for aesthetic or stylistic purposes. Outlets 26 can be spaced apart in the tangential direction 42 at a uniform distance within each of the rings 38. In an example, outlets 26 can be spaced in tangential direction 42 at a distance of between 4 mm and 10 mm, measured center-to-center. In a particular example, outlets 26 can be spaced in tangential direction 42 by about 6 mm. In the embodiment depicted, the tangential spacing of outlets 26 is approximately the same throughout all rings 38 except for the innermost ring 38*a*, which may have outlets 26 therein spaced apart by between 1.5 and 4 mm and in an embodiment about 2.5 mm. This may be done for visual appearances and/or for improved heat distribution adjacent center 36 of exterior surface 24. Other configurations are possible, including those in which the tangential spacing of outlets 26 increases with the distance of each ring 38 from center 36. In such an example, outlets 26 may form individual rows extending in radial direction 40 from adjacent center 36 to adjacent outer periphery 14. In a further example, shorter rows may extend from a midpoint along the radial direction 42 to adjacent outer periphery 14 to provide additional outlets 26 in such an area.

As further shown in the depiction of FIGS. 1-4, the spacing of rings 38 in radial direction 40 can vary, including depending on the distance of a particular ring 38 from center 36 and or outer periphery 14. In the present example, an outermost group of rings 38 disposed toward outer periphery 14, which in the present example includes five rings 38, can be spaced more closely together in radial direction 40 than the remaining rings 38 that are disposed toward center 36, which in the present example includes four rings 38. The outermost rings 38 can be spaced apart in the radial direction 40 by between 4 mm and 8 mm and, in one embodiment, about 5 mm, while the innermost rings 38 can be spaced apart by between 8 mm and 12 mm and, in one embodiment by about 10 mm. Other similar arrangements are possible, such as wherein consecutive rings 38 are spaced more progressively more closely from center 36 to outer periphery 14, or including pairs of closely-spaced rings 38 separated by a comparatively greater distance. Again, such arrangements can be used to optimize a desired heat distribution or to provide a desired visual appearance. In the illustrated example, the more closely-spaced outer rings 38 may provide additional heat toward outer periphery 14 to adequately heat a cooking implement that may be larger than burner 10.

Turning now to FIGS. 5 and 6, the components of burner 10, including base 12 and cap 18, as mentioned above, are structured to provide a generally even flow of combustible fuel (e.g., natural gas, propane, or the like) mixed with air to outlets 26, including through the open area 16 defined in base 12 and as enclosed by the interior 22 of cap 18.

Specifically, burner 10 can have a layered construction with a portion thereof incorporated into upper surface 30 of hob 32 (FIG. 2). In this manner, upper surface 30 can define a burner rim 44 therealong that is configured to receive base 12 therein by base 12 resting on the corresponding portion of surface 30. As shown, burner 10 is positioned beneath grate 34 extending at least partially above burner 10, as depicted in FIG. 2. Holder unit 46 is coupled internally within hob 32 opposite upper surface 30, so as to be opposite base 12 and such that the holder unit 46 is obscured from view. The fuel supply lines and igniter associated with holder 46 may also be positioned internally within hob 32. An example of a coupling of holder unit 46 within hob 32 is described in co-pending, commonly-assigned U.S. patent application Ser. No. 15/193,735, now U.S. Pat. No. 10,145,568, the entire disclosure of which is incorporated by reference herein.

As further shown in FIGS. 5 and 6, a stem 48 extending from a portion of base 12 is configured to extend through a corresponding opening 50 in upper surface 30 so as to be at least partially within holder unit 46. As described further below, venturi 52 is defined within stem 48 such that by positioning stem 48 within holder unit 46 an inlet end 54 of venturi 52 is generally open to air and fuel provided through holder unit 46. In this manner, venturi 52 can mix the air and fuel provided by holder unit 46 and can provide such fuel air mix through mix outlet 56 to a mixing chamber 62 defined within base 12.

As further shown in FIGS. 5 and 6, base 12 can include a lower body 64 that rests on surface 30 of hob 32 with a spreader 66 received within body 64 to collectively define the above-described mixing chamber 62 therebetween. Cap 18 can be assembled over corresponding portions of body 64 and spreader 66 to enclose burner 10 and to define the above-described distribution cavity 20 between the open area 16 defined within base 12, including by a central portion of spreader 66, and the interior 22 of cap 18. In this manner, a portion of mixing chamber 62 is separated from distribution cavity 20 such that the fuel-air mix received into mixing chamber 62 flows outwardly within mixing chamber 62 before entering distribution cavity 20 from an area disposed toward outer periphery 14.

As further shown, spreader 66 can define an inner wall 68 that extends generally parallel from an outer wall 70 of body 64 to define an upwardly-extending portion of mixing chamber 62. Inner wall 68 defines an upper edge 72 that is spaced below an overlying portion of interior 22 of cap 18 such that a gap 74 is defined therebetween. Gap 74 is present to provide, at least in part, fluidic communication between mixing chamber 62 and distribution cavity 20 for flow of the fuel-air mix out of mixing chamber 62 and into distribution cavity 20. Inner wall 68 can further define a plurality of ports 76 extending therethrough to provide for additional fluidic communication, and corresponding flow of fuel-air mix, between mixing chamber 62 and distribution cavity 20. In an embodiment, ports 76 can generally be defined by grooves extending generally from interior side wall 68 of spreader 66. In one example, body 64 and spreader 66 can be fabricated from aluminum, including various alloys thereof, or other suitable heat-resistant materials. Further, cap 18 can, for example, be made of cast iron, steel, aluminum, or the like. In various aspects, cooktop can be fabricated from enameled steel, stainless steel, aluminum, or the like.

With continued reference to FIGS. 5 and 6, the above-described venturi 52 is discussed in greater detail. As mentioned above, venturi 52 is defined internally within stem 48 of base 12 and defines air-fuel mix inlet 56 at an intersection thereof with a surrounding upper surface 78 of body 64. In this manner, stem 48 can be configured to extend to a desired depth within holder unit 46 such that the fuel provided by a fuel source within holder 46, which may be in the form of a jet, can enter venturi 52 through inlet 54 while drawing a desired amount of ambient air therein. In this manner, venturi 52 can be configured to provide a desired mix of fuel, delivered in the form of natural or propane gas, for example, mixed with a desired amount of air to be burned by burner 10.

In a particular embodiment, the inlet 54 of venturi 52 can be larger in area than the air-fuel mix inlet 56 by at least 50%. In a further aspect, venturi 52 can taper along the conical section 80 defined within venturi 52 adjacent the inlet 54 thereof, as depicted in FIG. 6. Such a conical section 80 can taper gradually along a straight side wall of venturi 52 toward the air-fuel mix inlet 56 to mixing chamber 62. In general, conical section 80 can have a height on the order of the diameter of inlet 64, i.e. within about 30% thereof. In one example, venturi inlet 54 can have a diameter of about 18 mm, and air-fuel mix inlet 56 can have a diameter of about 38 mm (all values+/−10%). In such an example, the height of conical section 80 can be about 30 mm such that an angle of conical section 80 can be about 72 degrees with respect to the horizontal, as depicted in FIG. 6.

As further illustrated in FIG. 6, a cylindrical section 82 can be defined between conical section 80 and the air fuel mix inlet 56 to mixing chamber 62. As illustrated, the cylindrical section 82 may be relatively short compared to the conical section 80. In one example, cylindrical section 82 can be between about 2 mm and 3 mm, and in a further example about 2.7 mm. As further illustrated, the transition between cylindrical section 82 and the surrounding surface 78 of body 64 can be relatively abrupt such that surface 78 extends immediately outwardly from an upper end of a cylindrical section 82 (i.e. along a 90 degree or greater angle defining a corner, in cross-section). Alternatively, a small fillet may be present between cylindrical section 82 and surface 78, a radius of such fillet being less than about 1 mm, and in one example about 0.5 mm. Such a configuration, in combination with the conical section 80 may provide a desired fuel-air mixture for ports 76 in light of the configuration and orientation thereof. Further, the above-described configuration of venturi 52 may provide a sufficiently consistent mixture of fuel and air and may provide such a mixture to mixing chamber 62 at a velocity sufficient to force such mixture therethrough through ports 76 and or gap 74 at a desired rate to maintain a desired pressure of the air-fuel mixture within distribution cavity 20 to provide a consistent flow thereof to outlets 26.

In connection with the above-described geometry of venturi 52, mixing chamber 62 may be configured as shown in FIG. 6 in which air-fuel mix inlet 56 is provided along a convex portion 84 of surface 78 that is spaced apart from a facing concave portion 86 of the facing surface of spreader 66. Further, the convex portion 84 of surface 78 and the concave portion 86 of spreader 66 can be spaced apart at distance configured to cooperate in connection with the above-described geometry of venturi 56 to provide the desired velocity and flow rate of the air fuel mixture to ports 76 and gap 74. In one aspect, convex portion 84 can be configured such that air-fuel mix inlet 56 is positioned above the remaining outside portion of surface 78 by about 4.8 mm, and further such that convex portion 84 has a radius of about 67 mm (all values+/−10%). The corresponding geometry of concave portion 86 can be configured to match that of convex portion 84 while maintaining the desired gap there between. In one example, the gap between convex portion 84 and concave portion 86 can be between about 3 mm and about 4 mm. In a further embodiment, the gap can be about 3.4 mm.

As shown in FIGS. 5 and 6, and as further discussed below, body 14 can define a plurality of secondary air ports 88 that can provide a flow of secondary air to distribution cavity 20 to maintain a desired mixture and/or pressure therein. In the illustrated embodiment, the ports 88 are defined collectively between body 64 and spreader 66. As illustrated, such ports 88 can be arranged at regular intervals extending vertically through base 12. To provide a desired flow of air through secondary air ports 88 surface 30 of hob 32 can be configured to space apart base 12 therefrom. As illustrated, such configuration can include the incorporation of support platforms 90 within surface 30 toward an interior of burner rim 44 and around a circumference thereof. As illustrated in FIGS. 5 and 6, base 12 can rest on support platforms 90, with the area therebetween providing access to a gap 92 thusly defined to provide a direct secondary air flow path to through secondary air ports 88 to cavity 20.

The above describe construction of burner 10, including the geometry of venturi 52, the configuration of mixing chamber 62 and the positioning of ports 74 within inner wall 68 and the presence of gap 74 between the upper edge 72 of inner wall 68 combine to provide a desired flow of the fuel-air mix to distribution cavity 20 that enters distribution cavity 20 from adjacent outer periphery 14 at a sufficient pressure and velocity for some of the fuel-air mix to reach the area of cavity 20 adjacent the center 36 of the exterior surface 24 of cap 18. In this manner, the air-fuel mix is able to reach the outlets 26 in the ring 38*a* closest to center 36. As can also be seen in FIG. 6, the construction of cap 18 helps achieve this distribution. In one aspect, cap 18 is convex with respect to exterior surface 24 such that the interior 22 of cap 18 extends upwardly in a concave manner with respect to the position of gap 74 and/or ports 76. This construction is such that the intersections of the various outlets 26 with respect to interior 22 of cap 18 increase in the vertical position thereof among the rings 38 that are positioned toward center 36. This arrangement allows some of the flow of the fuel-air mix to reach the outlets 26 disposed toward center 36 as portions of the flow exit distribution chamber 20 though the outlets 26 disposed toward outer periphery 14.

As further shown in FIG. 6, cap 18 can be additionally structured to contribute to the presence of gap 74 by positioning the portion of interior 22 adjacent inner wall 68 at a position vertically above upper edge 72. Such positioning can be related to the concave shape of interior 22 (and the convex shape of exterior surface 24). Cap 18 can also be configured to fit over base 12 by configuring cap 18 with an outer vertical wall 94 that fits closely over peripheral surface 96 of base 12, as defined by body portion 64. In particular, vertical wall 94 can fit in a close sliding arrangement over peripheral surface 96 without requiring a press-fit arrangement. In this manner, the fit is close enough to prevent the fuel-air mix from exiting through the interface between vertical wall 94 and peripheral surface 96. Further, cap 18 can be supported on base by a shoulder portion 98 of base 12 defined at the lower edge of peripheral surface 96. The vertical location of shoulder 98 and the vertical height of vertical wall 94 can contribute to the positioning of interior 22 of cap 18 with respect to the upper edge 72 of inner wall 68 to result in the desired size of gap 74. The particular concave shape of the cap 18 interior 22 can, further, be configured to provide a desired positioning of interior 22 above convex section 84 of spreader 66 to maintain a desired flow of the fuel-air mix through distribution cavity 20 as well as a desired pressure of the fuel-air mix therein.

Figure 7:
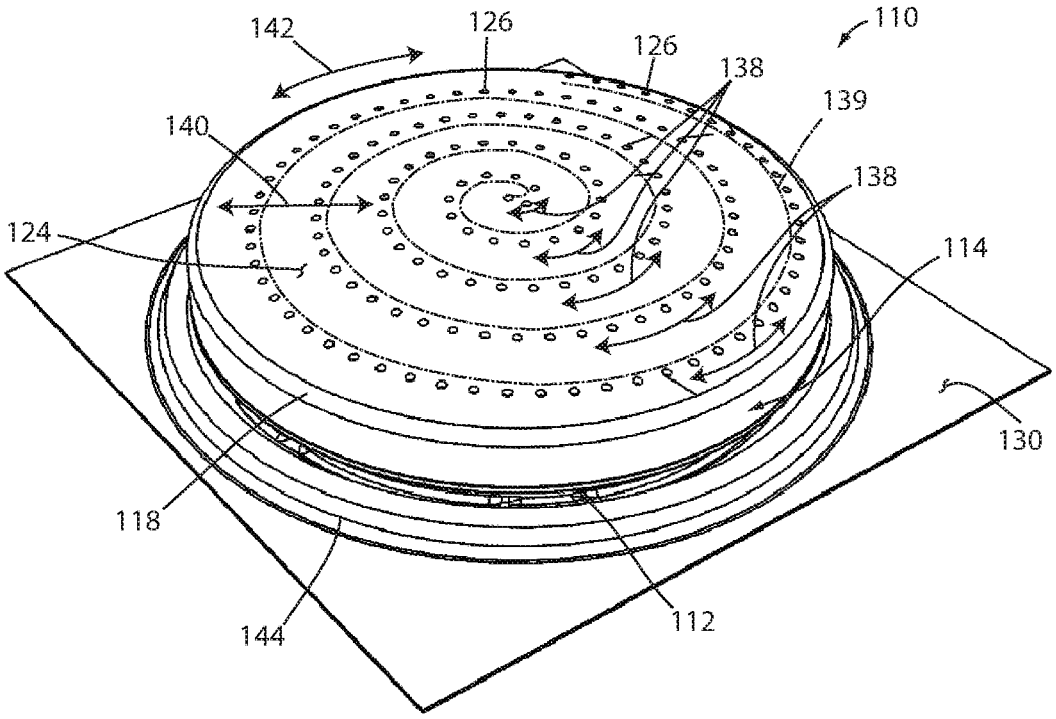
FIG. 7 is a perspective view of an alternative burner assembly.
Figure 8:
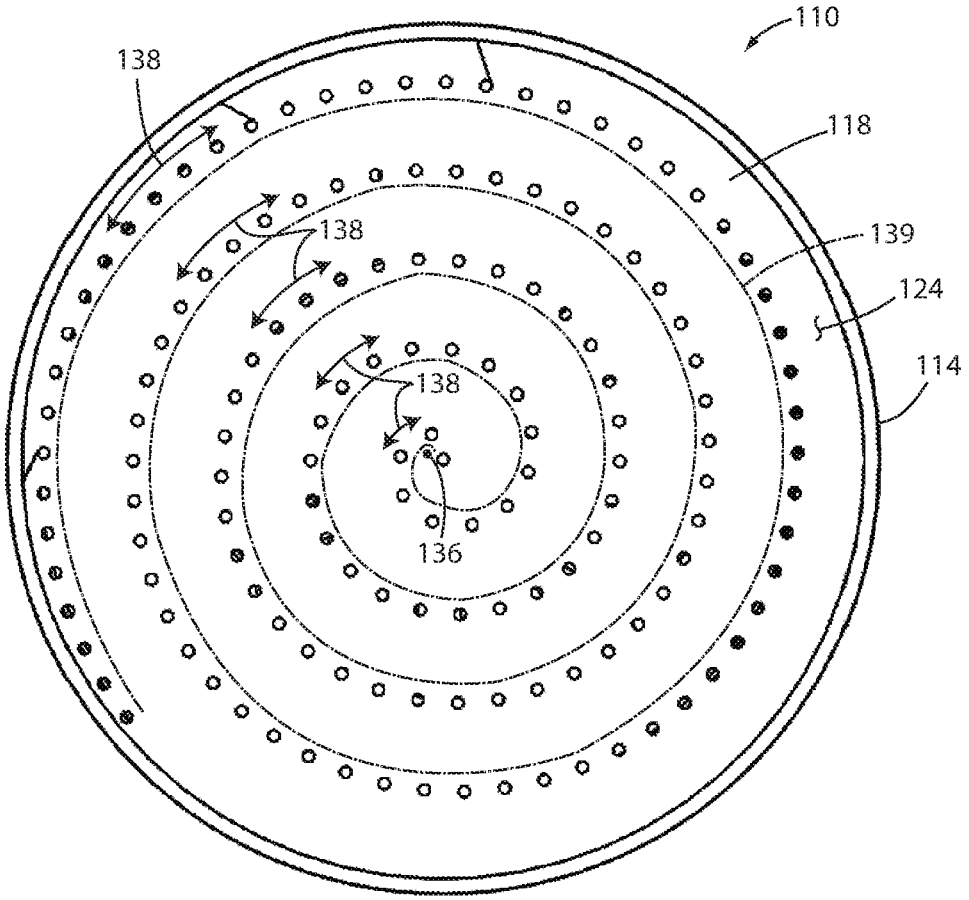
FIG. 8 is a top view of the burner of FIG. 7.

Turning now to FIGS. 7 and 8, an alternative embodiment of burner 110 is shown that is generally similar in construction to the burner 10 shown in FIGS. 1-6, with similar or identical features being similarly numbered, but increased by 100. Structures that are identical or structured according to similar principles are not described herein again with respect to burner 110. Generally, burner 110 is similar to burner 10, except that the openings through cap 118 (from distribution cavity 120 to exterior surface 124) are arranged in a spiral pattern 139 that emanates from adjacent center 136 and extends to adjacent outer periphery 114. The particular spiral pattern shown includes about 4.5 loops 138 (or traversals of cap 118 in the tangential direction 142 extending in radial direction 140). In one example, wherein the diameter of cap 118 is between 120 mm and 150 mm, such a pattern can result in even spacing of the loops 138 in radial direction 140 of between 12 mm and 15 mm. In an embodiment, the diameter of cap 118 can be about 140 mm and the spacing between loops 138 in radial direction 140 can be between about 13 mm toward center 136 and can expand somewhat to be about 15 mm toward outer periphery 114. The spacing of consecutive outlets 126 along the spiral pattern 139 (i.e. in a direction close to tangential direction 142) can be generally even at between about 5 mm and 10 mm. In one embodiment, the spacing between consecutive outlets 126 can be about 6.5 mm with between 2 and 5 of the outlets 126 closest to center 136 being more closely spaced, such as by 4.5 mm, for example.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A fuel-burning cooking burner, comprising:

a base defining an outer periphery and an inner open area; and a cap coupled with the base around the outer periphery thereof and extending over the open area to define a distribution cavity on an interior side of the cap, the cap further defining a convex exterior surface extending opposite the distribution cavity and a plurality of outlets extending through the cap from the distribution cavity to the exterior surface, the outlets being distributed over the entire exterior surface by being arranged in a plurality of concentric rings including an innermost ring, an outermost ring and a plurality of intermediate rings, wherein adjacent ones of the outlets in the outermost ring and the plurality of intermediate rings are spaced apart in a tangential direction around the outer periphery by the same distance.

2. The burner of claim 1, wherein the outlets are distributed over the entire exterior surface by including at least some of the outlets in the outermost ring positioned adjacent the outer periphery and at least some of the outlets in the innermost ring adjacent a center of the exterior surface.

3. The burner of claim 1, wherein the outermost ring, the innermost ring, and the plurality of intermediate rings are concentric and emanate from a center of the exterior surface.

4. The burner of claim 3, wherein the plurality of concentric rings are arranged in a first group and a second group, the first group including the outermost ring and being more closely spaced in a radial direction than the second group, which includes the innermost ring.

5. The burner of claim 3, wherein the outlets are all of a uniform size of between 1 mm and 2.5 mm.

6. The burner of claim 1, wherein the base defines a fuel-air mix inlet and a mixing chamber, the mixing chamber being in communication with the fuel-air mix inlet and with the distribution cavity remote from the fuel-air mix inlet and further being separated from a portion of the distribution cavity.

7. The burner of claim 6, wherein the base includes an inner wall spaced inward from the outer periphery and defining a portion of the mixing chamber surrounding the distribution cavity.

8. The burner of claim 7, wherein the mixing chamber is open to the distribution cavity along an upper edge of inner wall that is spaced apart from an interior of the cap.

9. The burner of claim 7, wherein the mixing chamber is open to the distribution cavity through a plurality of ports extending through the wall.

10. A fuel-burning cooking burner, comprising:

a base defining an outer periphery, an inner open area, a mixing chamber separated from a portion of the inner open area and in communication therewith adjacent the outer periphery, and an inner wall spaced inward from the outer periphery and including a plurality of ports extending through the inner wall; and a cap coupled with the base around the outer periphery thereof and extending over the open area to define a distribution cavity on an interior side of the cap, the cap further defining an exterior surface extending opposite the distribution cavity and a plurality of outlets extending through the cap from the distribution cavity to the exterior surface;

wherein the inner wall defines a portion of the mixing chamber surrounding the distribution cavity and the mixing chamber is open to the distribution cavity through the plurality of ports.

11. The burner of claim 10, wherein the outlets are distributed over the entire exterior surface.

12. The burner of claim 11, wherein the outlets are distributed over the entire exterior surface by including at least some of the outlets in positions adjacent the outer periphery and at least some of the outlets adjacent a center of the exterior surface.

13. The burner of claim 12, wherein the outlets are arranged in concentric rings emanating from a center of the exterior surface.

14. The burner of claim 13, wherein the concentric rings are more closely spaced in a radial direction toward the outer periphery than toward the center.

15. The burner of claim 13, wherein the concentric rings are characterized by uniform size and generally equal tangential spacing of the outlets among the concentric rings.

16. The burner of claim 10, wherein the cap further defines a convex exterior surface extending opposite the distribution cavity.

17. The burner of claim 10, wherein the mixing chamber is open to the distribution cavity along an upper edge of inner wall that is spaced apart from an interior of the cap.

18. A cooking appliance, comprising:

an upper surface;

a burner disposed along the upper surface, including:

a base defining an outer periphery and an inner open area; and a cap coupled with the base around the outer periphery thereof and extending over the open area to define a distribution cavity on an interior side of the cap, the cap further defining a convex outer surface extending opposite the distribution cavity and a plurality of outlets extending generally perpendicular to the upper surface and through the cap from the distribution cavity to the exterior surface, the outlets being distributed over the entire exterior surface by being arranged in a plurality of concentric rings including an innermost ring, an outermost ring and a plurality of intermediate rings, wherein adjacent ones of the outlets in the outermost ring and the plurality of intermediate rings are spaced apart in a tangential direction around the outer periphery by the same distance; and a grate disposed above the burner and supported along a portion of the upper surface.

19. The cooking appliance of claim 18, wherein the plurality of concentric rings are arranged in a first group and a second group, the first group including the outermost ring and being more closely spaced in a radial direction than the second group, which includes the innermost ring.

20. The cooking appliance of claim 18, wherein:

the base defines a fuel-air mix inlet and a mixing chamber, the mixing chamber being in communication with the fuel-air mix inlet and with the distribution cavity remote from the fuel-air mix inlet and further being separated from a portion of the distribution cavity;

the base includes an inner wall spaced inward from the outer periphery and defining a portion of the mixing chamber surrounding the distribution cavity; and the mixing chamber is open to the distribution cavity through a plurality of ports extending through the wall.

* * * * *